US011455887B1

(12) United States Patent
Chen et al.

(10) Patent No.: US 11,455,887 B1
(45) Date of Patent: Sep. 27, 2022

(54) SYSTEMS AND METHODS TO LOCATE A PARKING SPOT FOR A VEHICLE

(71) Applicant: Ford Global Technologies, LLC, Dearborn, MI (US)

(72) Inventors: Yifan Chen, Ann Arbor, MI (US); Kwaku O. Prakah-Asante, Commerce Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/407,453

(22) Filed: Aug. 20, 2021

(51) Int. Cl.
*G08G 1/14* (2006.01)

(52) U.S. Cl.
CPC ..... *G08G 1/143* (2013.01); *G08G 1/146* (2013.01); *G08G 1/148* (2013.01)

(58) Field of Classification Search
None
See application file for complete search history.

(56) References Cited

U.S. PATENT DOCUMENTS 8,432,297 B2 4/2013 Sonnabend et al.
9,805,602 B2 10/2017 Tobolski et al.
10,522,037 B1 * 12/2019 Batra ..... G08G 1/065
2008/0048885 A1 2/2008 Quinn
2016/0012726 A1 1/2016 Wang

OTHER PUBLICATIONS

Shi Dong et al, "Parking rank: a novel method of parking lots sorting and recommendation based on public information", IEEE International Conference on Industrial Technology, 2018, IEEE Xplore, 1 page.
M. Figliozzi et al, "Impact of Last Mile Parking Availabilty on Commercial Vehicle Costs and Operations", Supply Chain Forum, an International Journal, vol. 18, Issue 2, May 30, 2017, 5 pages.

* cited by examiner

*Primary Examiner* — John F Mortell
(74) *Attorney, Agent, or Firm* — Brandon Hicks; Eversheds Sutherland (US) LLP

(57) ABSTRACT

This disclosure is generally directed to systems and methods to locate a parking spot for a vehicle. In an example method, an address of a destination for a trip is provided to a processor. The processor identifies a cluster of parking spots based on determining a statistical probability that at least one parking spot in the cluster of parking spots is available at an expected time of arrival of the vehicle at the cluster of parking spots. An availability of the first parking spot is then checked by the processor at a time of arrival of the vehicle at a perimeter of the cluster of parking spots. The processor may direct the vehicle to travel from the perimeter to either the first parking spot if still available, or to a second parking spot if the first parking spot is unavailable.

19 Claims, 6 Drawing Sheets

SYSTEMS AND METHODS TO LOCATE A PARKING SPOT FOR A VEHICLE

BACKGROUND

Delivery services for delivering various types of products have been around for many years. Most of these delivery services use drivers for driving delivery vehicles and have attempted to maximize profit margins by optimizing various operating parameters such as delivery routes, delivery times, driving distances, and vehicle fuel consumption. The delivery services have also attempted to minimize time spent by drivers when driving along a delivery route and when delivering packages at customer locations. Some delivery services have also begun using autonomous vehicles to execute deliveries and are making attempts to optimize these types of deliveries as well.

However, certain aspects of delivery operations of either type may benefit from additional scrutiny and optimization that may have been left unidentified and unaddressed at this time. For example, it may be desirable to minimize the amount of time spent by a driver (or by an autonomous vehicle) in locating a parking spot close to a package delivery destination, especially when the package delivery destination is located in a congested area, such as in a downtown area of a large city, and a parking fee has to be paid for parking at a metered parking spot.

BRIEF DESCRIPTION OF THE DRAWINGS

A detailed description is set forth below with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
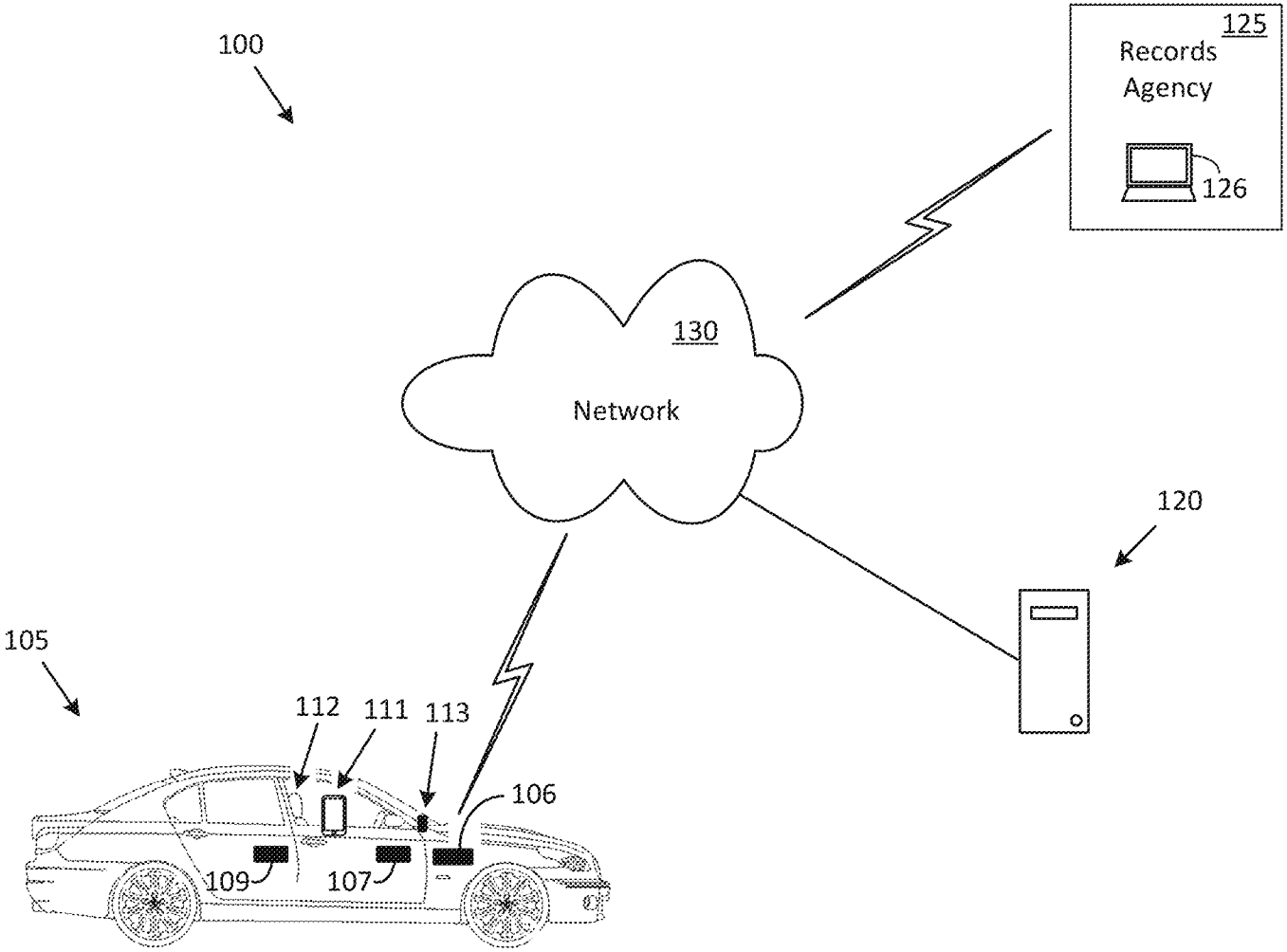
FIG. 1 shows an example system that includes a vehicle configured to automatically locate a vacant parking spot in accordance with an embodiment of the disclosure.

In terms of a general overview, certain embodiments described in this disclosure are directed to systems and methods related to locating a parking spot for a vehicle. In an example method, an address of a destination for a trip is input into a computer. The computer may be provided in a vehicle or can be a personal communication device (a smartphone, for example). Also input into the computer, is a specified level of certainty (50%, 80%, 100%, etc.) to be associated with a vacant parking spot located within a specified maximum walking distance of the destination. The computer identifies a cluster of parking spots that are located within the specified maximum walking distance and performs a statistical analysis of an occupancy history of the cluster of parking spots. Based on the analysis, the computer offers a guarantee that a parking spot will be available with the specified level of certainty, at a time of arrival of the vehicle near the destination. In an example scenario, the vehicle is a delivery vehicle, the specified level of certainty may be defined on the basis of a density of parking spots located within the specified maximum walking distance and the specified maximum walking distance may be defined on the basis of an amount of time taken for a driver of the vehicle to walk from the vehicle to the address when carrying a package for delivery at the address. The specified maximum walking distance may also be defined on the basis of a weight, a size, and/or a shape of the package to be delivered at the address.

In another example method, the computer may define a search area, based on the specified level of certainty, in order to identify a cluster of parking spots. The computer performs a statistical analysis of an occupancy history of parking spots in the cluster of parking spots in order to identify an available parking spot at an expected time of arrival of the vehicle. The computer then issues a directive to the driver of the vehicle (or to a computer of an autonomous vehicle) to start driving towards a center spot of the search area. Upon detecting the entry of the vehicle into the search area, the computer verifies the current availability status of the parking spot. If the parking spot is still available, the computer directs the driver (or the autonomous vehicle) to drive to the parking spot. If no longer available, the computer directs the driver (or the autonomous vehicle) to drive to an alternative parking spot. The alternative parking spot may be available with a level of certainty that is different than the specified level of certainty (lower or higher).

In yet another example method, an address of a destination for a trip by a vehicle is provided to a processor. The processor can be a part of a computer located in the vehicle or can be a personal communication device (a smartphone, for example). The processor identifies a cluster of parking spots based on determining a statistical probability that at least one parking spot in the cluster of parking spots is available at an expected time of arrival of the vehicle at the cluster of parking spots. An availability of the first parking spot is then checked by the processor at a time of arrival of the vehicle at a perimeter of the cluster of parking spots. The processor may direct the vehicle to travel from the perimeter to either the first parking spot if still available, or to a second parking spot if the first parking spot is unavailable.

Illustrative Embodiments

The disclosure will be described more fully hereinafter with reference to the accompanying, drawings, in which example embodiments of the disclosure are shown. This disclosure may, however, be embodied in many different forms and should not be construed as limited to the example embodiments set forth herein. It will be apparent to persons skilled in the relevant art that various changes in form and detail can be made to various embodiments without departing, from the spirit and scope of the present disclosure. Thus, the breadth and scope of the present disclosure should not be limited by any of the above-described example embodiments but should be defined only in accordance with the following claims and their equivalents. The description below has been presented for the purposes of illustration and is not intended to be exhaustive or to be limited to the precise form disclosed. It should be understood that alternate implementations may be used in any combination desired to form additional hybrid implementations of the present disclosure. For example, any of the functionality described with respect to a particular device or component may be performed by another device or component. Furthermore, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments.

Certain words and phrases are used herein solely for convenience and such words and terms should be interpreted as referring to various objects and actions that are generally understood in various forms and equivalencies by persons of ordinary skill in the art. For example, the word "vehicle" as used herein encompasses any of various types of automobiles. Words such as, for example, "person" or "individual," may be used herein in an interchangeable manner and must be understood to generally refer to a person who is associated with a vehicle. For example, an "individual" may be a "driver" of a vehicle in some situations and a "passenger" of the vehicle in some other situations. "vacant," "available," "unoccupied," and "empty." Phrases such as "parking spot" and "parking meter" as used herein in an interchangeable manner apply to any of various types of paid as well as free parking spots such as, for example, a metered parking spot, a free curbside parking spot, a parking lot, a public garage, a private garage, or a sidewalk. It must be understood that words such as "implementation," "scenario," "case," and "situation" are to be understood as examples in accordance with the disclosure. It should also be understood that the word "example" as used herein is intended to be non-exclusionary and non-limiting in nature.

FIG. 1 shows an example system 100 that includes a vehicle 105 configured to automatically locate a vacant parking spot in accordance with an embodiment of the disclosure. The vehicle 105 may be any of various types of vehicles such as, for example, a car, a van, a sports utility vehicle, a truck, a van, a bus, a gasoline vehicle, a driver-operated vehicle, an electric vehicle, a battery electric vehicle, a hybrid vehicle, a semi-autonomous vehicle, or an autonomous vehicle. In the illustrated example scenario, the vehicle 105 is operated by a driver 112. In another example scenario, the vehicle 105 is an autonomous vehicle.

The vehicle 105 may include components such as, for example, a vehicle computer 106, an infotainment system 113, a wireless communication system 109, and a parking spot locator computer 107. The components, which are symbolically depicted as black boxes in FIG. 1, may be installed at various locations on the vehicle 105, such as, for example, an engine compartment, a glove compartment, a trunk, a console inside the cabin area, or an exterior portion of the vehicle 105.

The vehicle computer 106 may perform various functions such as, for example, controlling engine operations (fuel injection, speed control, emissions control, braking, etc.), managing climate controls (air conditioning, heating etc.), activating airbags, and issuing warnings (check engine light, bulb failure, low tire pressure, vehicle in blind spot, etc.). In some cases, the vehicle computer 106 may include more than one computer such as, for example, a first computer that controls engine operations and a second computer that operates the infotainment system 113.

The infotainment system 113 can be an integrated unit that includes various components such as a radio, streaming audio solutions, USB access ports for digital audio devices, and a global positioning system (GPS). In an example implementation, the infotainment system 113 has a display that includes a graphical user interface (GUI) for use by the driver 112 and/or a passenger of the vehicle 105. The GUI may be omitted in some implementations, such as, for example, where the vehicle 105 is an autonomous vehicle.

The GUI may be used for various purposes such as to allow the driver 112 of the vehicle 105 to make a request to locate an unoccupied parking spot when the driver 112 (or a passenger of the vehicle 105, when the vehicle is an autonomous vehicle) desires to travel to a destination. In an example scenario, the vehicle 105 is a delivery vehicle and the driver 112 is a delivery person dropping off a package at the destination. In another example scenario, the vehicle 105 is an autonomous delivery vehicle that autonomously travel to a package drop-off location where a customer who may have purchased an item contained in the package can retrieve the package from the autonomous vehicle.

In an example embodiment, the driver 112 of the vehicle 105 may enter a request into the infotainment system 113 or a personal communication device 111 to locate an unoccupied parking spot when the driver 112 (a delivery person, for example) desires to travel to a destination. The personal communication device 111 can be any of various devices such as, for example, a smartphone, a wearable computer, a tablet computer, a phablet (phone plus tablet computer), or a laptop computer, or a desktop computer. Any of these devices may be operated by the driver 112 either when seated inside the vehicle 105 or when outside the vehicle 105 (such as, for example, when in a residence, an office, a warehouse, a store, a package sorting facility, a manufacturing facility, a loading dock, a parking garage, a sidewalk, etc.)

The parking spot locator computer 107, which is communicatively coupled to the infotainment system 113 and/or the personal communication device 111, is configured to execute various operations in accordance with the disclosure. In an example scenario, an individual such as, for example, the driver 112 of the vehicle 105 may input into the parking spot locator computer 107, information pertaining to travel by the vehicle 105 to a destination.

In an example scenario, the information entered into the parking spot locator computer 107 can include, for example, an address of the destination and a request to locate an unoccupied parking spot near the destination at an expected time of arrival of the vehicle 105 in the vicinity of the destination. In one case, the driver 112 of the vehicle 105 is a delivery person planning to drop off a package at the destination (an office of a business facility, for example) at a certain time of day (around 2 PM, for example). The package drop-off may be one of several package drop-offs scheduled for the day, and the driver 112 desires to optimize time spent on the delivery route. The optimization requires minimizing an amount of time when dropping off the package at the destination. One way to do so would be to locate a parking spot as close as possible to the destination and one that provides an optimal amount of time for the driver 112 to make the delivery (get off the vehicle 105, enter the business facility, drop off the package return to the vehicle 105, and get into the vehicle 105). Finding such a parking spot can be challenging in some areas, such as, for example, in a downtown area where parking spots are in high demand and curbside parking may be prohibited. More particularly, it is undesirable for the driver 112 to waste time in locating an unoccupied parking spot by cruising around the area looking for one.

Consequently, in an example embodiment, the driver 112 not only inputs into the parking spot locator computer 107, the address of the destination, but also inputs a specified level of certainty with which a vacant parking spot must be located. In one case, for example, the driver 112 may insist that a vacant parking spot be located with an 80% level of certainty. The parking spot locator computer 107 may be unable to locate an unoccupied parking spot with such a high level of certainty and may suggest that the driver 112 either provide a lower level or provide a maximum walking distance that the driver 112 is willing to walk for delivering the package. Decreasing the level of certainty and/or increasing the walking distance may improve the chance of finding an unoccupied parking spot. However, in some cases, the driver 112 may be constrained to specifying a maximum walking distance based on factors such as, for example, a weight, a size, and/or a shape of a package to be delivered, an amount of time available to the driver 112 for making a delivery, and/or a risk of package theft from the vehicle 105 if left unattended.

In an example procedure, the parking spot locator computer 107 identifies a cluster of parking spots that are located within the maximum walking distance specified by the driver 112, and performs a statistical analysis of an occupancy history of the cluster of parking spots. Based on the analysis, the parking spot locator computer 107 offers a guarantee that a parking spot will be available with the specified level of certainty, at a time of arrival of the vehicle 105 near the destination. In an example scenario, the specified level of certainty may be directly or indirectly dependent on a density of parking spots located within the specified maximum walking distance.

In another example procedure, the parking spot locator computer 107 may define a search area based on the specified level of certainty, and may use the search area to identify a cluster of parking spots. The parking spot locator computer 107 may then perform a statistical analysis of an occupancy history of parking spots in the cluster of parking spots in order to identify an available parking spot at an expected time of arrival of the vehicle 105. After identifying an available parking spot, the parking spot locator computer 107 may issue a directive to the driver of the vehicle 105 (or communicate to a computer in an autonomous vehicle) to start driving towards a center spot of the search area.

The parking spot locator computer 107 may use GPS information obtained from the GPS in the infotainment system 113 for tracking a movement of the vehicle 105, and upon detecting the entry of the vehicle 105 into the search area, verify the current availability status of the parking spot. If the parking spot is still available, the parking spot locator computer 107 may direct the driver 112 (or the autonomous vehicle) to drive to the vacant parking spot. If no longer available, the parking spot locator computer 107 may direct the driver 112 (or the autonomous vehicle) to drive to an alternative parking spot. The alternative parking spot may be available with a level of certainty that is different than the specified level of certainty (lower or higher).

Operations such as the example ones described above that are carried out by the parking spot locator computer 107 may involve the parking spot locator computer 107 using the wireless communication system 109 to wirelessly communicate with various systems and devices via a network 130. The network 130 may include any one, or a combination of networks, such as a local area network (LAN), a wide area network (WAN), a telephone network, a cellular network, a cable network, a wireless network, and/or private/public networks such as the Internet. For example, the network 130 may support communication technologies such as Bluetooth®, cellular, near-field communication (NFC), Wi-Fi, Wi-Fi direct, machine-to-machine communication, and/or man-to-machine communication. At least one portion of the network 130 includes a wireless communication link that allows the parking spot locator computer 107 to communicate via the wireless communication system 109 with a server computer 120 and/or a computer 126 that is located in a records agency 125.

The server computer 120 may be configured to perform some or all functions of the parking spot locator computer 107 such as the ones described herein. In an example implementation, the server computer 120 may accept input from an individual (such as the driver 112, for example) and identify a vacant parking spot by using one or more procedures such as the ones described herein. The server computer 120 may cooperate with the parking spot locator computer 107 during execution of such procedures, or may convey the results of the procedure (an availability of a parking spot, for example) to the parking spot locator computer 107.

The computer 126 that is located in the records agency may be a single computer or can be a network of computers configured to provide certain types of information to the parking spot locator computer 107, the personal communication device 111, and/or the server computer 120. The information can include, for example, locations of various types of parking spots (free, lot fees, metered, etc.), parking meter information, parking fees, parking-related timing information (peak hours, no-parking hours, off-peak hours, weekend use, etc.), and/or laws and ordnances governing the use of various parking spots. The parking spot locator computer 107, the personal communication device 111, and/or the server computer 120 can access this information via the network 130 and use the information to assess availability of various parking spots at various locations and at various times of the day.

Figure 2:
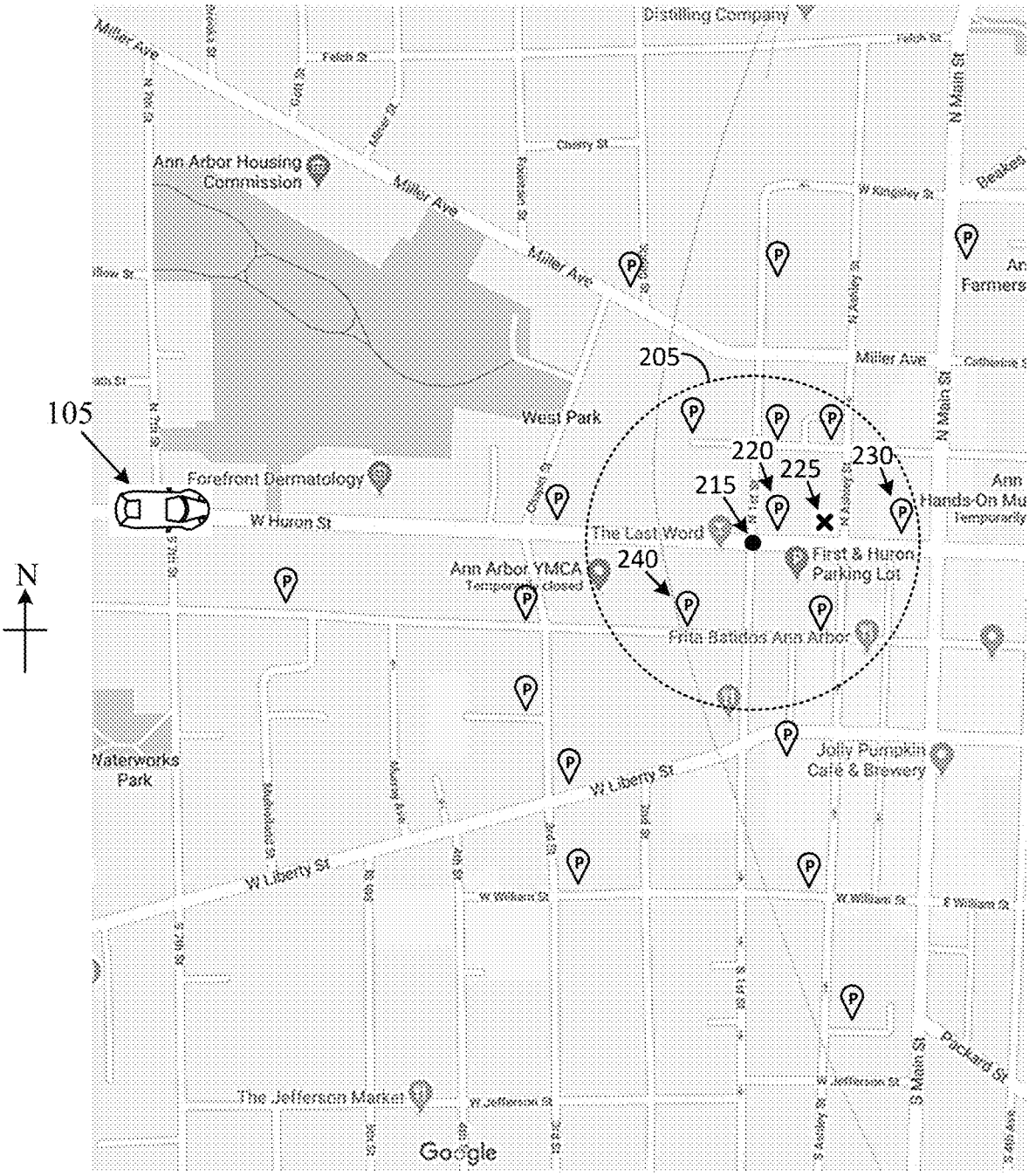
FIG. 2 illustrates an example scenario associated with a procedure to identify a vacant parking spot in accordance with an embodiment of the disclosure.

FIG. 2 illustrates an example scenario associated with a procedure to identify a vacant parking spot in accordance with an embodiment of the disclosure. In this example scenario, the vehicle 105 is a delivery vehicle driven by the driver 112 on a delivery route which can include several destinations. In another scenario, the vehicle 105 can be an autonomous vehicle that services the delivery route. The driver 112 may enter a request into a computer (such as, for example, the infotainment system 113 or the personal communication device 111) in order to locate an unoccupied parking spot close to a destination 225. The request may include a level of certainty that the driver 112 may specify. The level of certainty can be based on various factors such as, for example, time constraints associated with the delivery schedule, nature of packages to be delivered (size, shape, weight, volume, number of packages, etc.), nature of the neighborhood in which the destination 225 is located (in this example, a congested office district), availability of parking facilities, type of parking facilities, parking fees, and time of day.

In an example scenario, the driver 112 may evaluate such factors and specify that a vacant parking spot should be located with an 80% level of certainty, and within a specified maximum walking distance of the destination 225 such as, for example, one city block from the destination 225. In another example scenario, the driver 112 may specify a different maximum walking distance (100 feet, 20 feet, half a city block, an adjacent street, etc.) or may entirely rule out a walking distance (zero walking distance). By ruling out a walking distance, the driver 112 is specifying that the parking spot locator computer 107 should locate a parking spot adjacent to the destination 225, such as, for example, a curbside parking spot that allows the driver 112 to deposit a package on a sidewalk, driveway, yard, or on the premises of a building, for pickup by the customer.

The parking spot locator computer 107 may locate one or more vacant parking spots based on the level of certainty and the maximum walking distance specified by the driver 112. In an example embodiment, the parking spot locator computer 107 may locate one or more parking spots by first defining a circular search area having a radius that is either equal to, or less than, the specified maximum walking distance. In another example embodiment, the parking spot locator computer 107 may locate one or more parking spots by defining a search area having a shape other than a circle (square, rectangle, octagonal, oval, etc.). A center of the search area may be located at the specified destination (destination 225, in this example) or at any other spot close to the specified destination (such as, for example, at an intersection of two roads near the destination 225, at a public parking lot near the destination 225, at a covered garage located near the destination 225, or in front of a landmark building near the destination 225).

In the illustrated example scenario, the parking spot locator computer 107 defines a search area 205 that is in the shape of a circle and having a center 215 located at an intersection of two roads near the destination 225. The search area encompasses a cluster of parking spots and the parking spot locator computer 107 may evaluate each parking spot based on the specified level of certainty and a statistical analysis of an occupancy history of the parking spots. Additional details pertaining to the statistical analysis are provided below.

The density of parking spots inside the search area 205 is high in comparison to other areas in the example map shown in FIG. 2 and an evaluation of the parking spots allows the parking spot locator computer 107 to associate a level of certainty for availability of each of the parking spots. For example, the parking spot locator computer 107 may associate a 70% level of certainty for availability of a parking spot 220, an 80% level of certainty for availability of parking spot 230, a 90% level of certainty for availability of parking spot 240, and so on for the other parking spots among the cluster of parking spots located inside the search area 205.

Based on the input provided by the driver 112, the parking spot locator computer 107 may issue a directive to the driver 112 to start driving towards the destination 225 and may also provide a guarantee that the parking spot 230 will be available with the 80% specified level of certainty at a time of arrival of the vehicle 105 at the parking spot 230. The vehicle 105 may respond to the directive and start traveling towards the parking spot 230 with the expectation that the parking spot 230 is available with the 80% specified level of certainty.

In an example scenario, the statistical analysis of an occupancy history of the parking spot 230 may indicate to the parking spot locator computer 107 that a high level of traffic churn exists in the area near the parking spot 230 at certain times of the day and that the specified level of certainty for availability of the parking spot 230 may fluctuate in an unpredictable manner at various times during the day.

Consequently, in an exemplary embodiment, the parking spot locator computer 107 may issue a directive to the driver 112 to start driving towards the destination 225 without providing a guarantee that the parking spot 230 will be available with the 80% specified level of certainty at a time of arrival of the vehicle 105 at the parking spot 230. The parking spot locator computer 107 may then begin tracking the movement of the vehicle 105 (via the GPS in the infotainment system 113, for example) and detect an entry of the vehicle 105 into the search area 205. Upon making the detection, the parking spot locator computer 107 may re-evaluate the availability status of the parking spot 230. If the parking spot 230 is still available, the parking spot locator computer 107 may instruct the driver 112 to drive towards the parking spot 230. However, if the parking spot locator computer 107 determines that the parking spot 230 will be unavailable when the vehicle 105 arrives at the parking spot 230, the parking spot locator computer 107 may issue a new directive to the driver 112 to drive to an alternative parking spot, such as for example, the parking spot 220 that has a 70% level of certainty for availability, which is lower than the 80% level of certainty specified by the driver 112. In one case, the driver 112 may accept the second directive and proceed to drive to the parking spot 220. In another case, the driver 112 may find the 70% level of certainty unacceptable and may request the parking spot locator computer 107 to identify an alternative parking spot that has an 80% or higher level of certainty of availability. The parking spot locator computer 107 may respond to the request by directing the driver 112 to drive to the parking spot 240 having a 90% level of certainty for availability. The parking spot 240 is located at a distance that is greater than the one block maximum walking distance specified by the driver 112. The driver 112 may be provided this information as well, and may make a decision (based on factors such as, for example, an availability of time, fewer packages to be carried, and/or lighter packages to be carried) to proceed to the parking spot 240 or to drive towards the parking spot 220 and cruise around until the parking spot 220 becomes available (heavier packages to be carried, for example).

Figure 3:
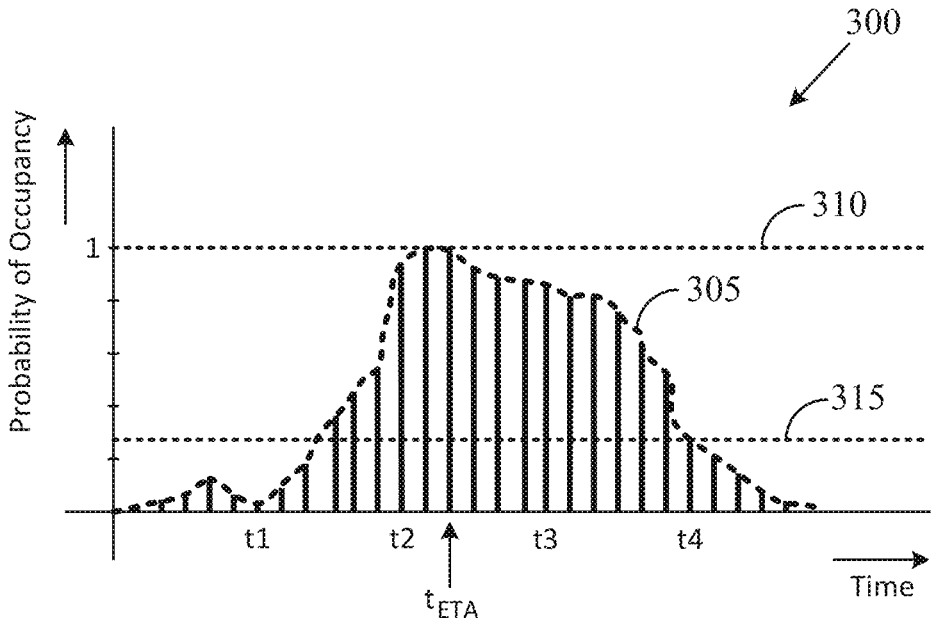
FIG. 3 shows a probability chart that may be used by a parking spot locator computer to determine an availability of a first example parking spot in accordance with the disclosure.

FIG. 3 shows a probability chart 300 that may be used by the parking spot locator computer 107 to determine an availability of a first parking spot in accordance with the disclosure. More particularly, the probability chart 300 allows the parking spot locator computer 107 to perform a statistical analysis of an occupancy history of the first parking spot. Each of the vertical lines in the probability chart 300 corresponds to historical occupancy data obtained at various times of the day or week, for example. In an example implementation, historical occupancy data is associated with a parking meter located at the first parking spot. In another example implementation, historical occupancy data is associated with measurements obtained by a counting device or an observer. The envelope 305 of the various vertical lines over a period of time (a day, for example) corresponds to a probability of occupancy of the first parking spot. A level 310 corresponds to a 100% probability that the first parking spot is occupied at a corresponding sampling instant indicated on the x-axis of the probability chart 300.

At an expected time of arrival ($t_{ETA}$) of the vehicle 105 at the first parking spot, the probability ($P_1(t)$) of the first parking spot being occupied and unavailable is 100%. If the vehicle 105 were to arrive at the first parking spot at a different time, for example at t4, the probability ($P_1(t)$) of the first parking spot being occupied and unavailable is about 25% (indicated by the dashed line 315). Conversely, the probability ($P_1(t)$) of the first parking spot being available at the time t4 is about 75% (100%−25%==75%) (or 0.75 on a scale of 0 to 1). In general, the probability of the first parking spot being unavailable at any specific instant "t" in time can be defined as $P_1(t)$ and conversely, the probability of the first parking spot being available at any specific instant "t" in time can be defined as $(1-P_1(t))$.

Figure 4:
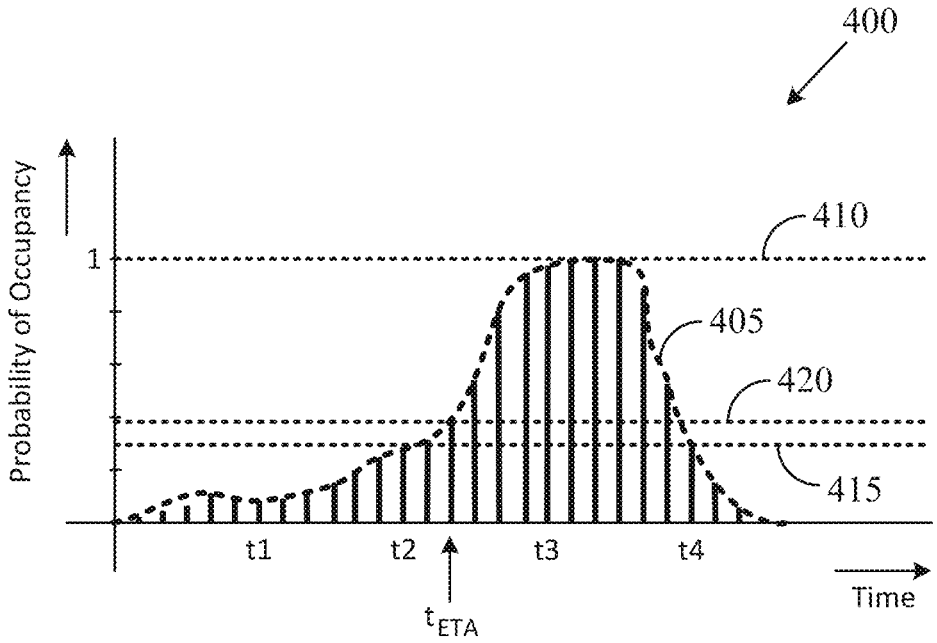
FIG. 4 shows a probability chart that may be used by a parking spot locator computer to determine an availability of a second example parking spot in accordance with the disclosure.

FIG. 4 shows a probability chart 400 that may be used by the parking spot locator computer 107 to determine an availability of a second parking spot in accordance with the disclosure. The description provided above with respect to the probability chart 300 is equally applicable to the probability chart 400. The envelope 405 of the various vertical lines over a period of time (a day, for example) corresponds to a probability of occupancy of the second parking spot. A level 410 corresponds to a 100% probability that the second parking spot is occupied at a corresponding sampling instant indicated on the x-axis of the probability chart 400.

It should be noted, however, that at an identical expected time of arrival ($t_{ETA}$) of the vehicle 105 at the second parking spot instant, the probability ($P_2(t)$) of the second parking spot being occupied and unavailable is about 39% (indicated by the dashed line 420). Conversely, the probability ($P_2(t)$) of the second parking spot being available at the time $t_{ETA}$ is about 61% (100%−39%).

If the vehicle 105 were to arrive at the second parking spot at time t4, the probability ($P_2(t)$) of the second parking spot being occupied and unavailable is about 30% (indicated by the dashed line 415). Conversely, the probability ($P_2(t)$) of the second parking spot being available at the time t4 is about 70% (100%−30%). In general, the probability of the second parking spot being unavailable at any specific instant "t" in time can be defined as $P_2(t)$ and conversely, the probability of the second parking spot being available at any specific instant "t" in time can be defined as $(1-P_2(t))$.

Based on use of the probability of occupancy (nonavailability) chart shown in FIG. 3 and FIG. 4, the probability $A_{12}(t)$ of at least one of the first parking spot or the second parking spot being available at any given instant in time can be expressed by the following equation:

$$A_{12}(t)=(1-P_1(t))+(1-P_2(t))-(1-P_1(t))*(1-P_2(t))$$

The description provided above with reference to a single parking spot, or two parking spots, is equally applicable to "n" number of parking spots (n≥1) in a cluster of parking spots. The parking spot locator computer 107 can select "n" to be any suitable value in order to satisfy a level of certainty and/or a maximum walking distance specified in a request for locating a vacant parking spot in accordance with the disclosure. The parking spot locator computer 107 can also use a discrete choice model to identify a most suitable parking spot. The discrete choice model may take into consideration various factors, and may associate a score (in the form of a weighting factor) to a parking spot in order to calculate a merit value for a parking availability score (Parking_value_k). The parking availability score can be expressed in the form of the following equation:

$$\text{Parking_value_k} = \sum_{i=1}^{N} \omega_i m_i$$

where $m_i$ is an input from a set of key ranking factors (using a scale of 0 to 1, for example) and $w_i$ is a weight attributed to each leading ranking factor.

Some example inputs can include, for example:

- $m_1$: a likelihood that a parking spot will remain available at an expected time of arrival of the vehicle 105 (based on a statistical analysis of an occupancy history of the parking spot)
- $m_2$: a parking spot that is reserved for loading and/or unloading packages
- $m_3$: a distance to the destination 225 from a current location of the vehicle 105
- $m_4$: an availability of curbside parking
- $m_5$: a parking fee associated with a parking spot In an example scenario, the parking spot locator computer 107 may evaluate three potential parking spots and arrive at a result in the following format:

max(Parking_value_1,Parking_value_2,Parking_value_3)

The weights for each factor may be adjusted in order to emphasize a degree of contribution of the factor to a ranking of the parking spot among several parking spots in a cluster of parking spots. The parking spot locator computer 107 may direct the vehicle 105 to travel to a first parking spot having the highest ranking in a cluster of parking spots. If the first parking spot is occupied at the time of arrival of the vehicle 105 at the first parking spot, the parking spot locator computer 107 may redirect the vehicle 105 to a second parking spot having the next highest ranking.

Figure 5:
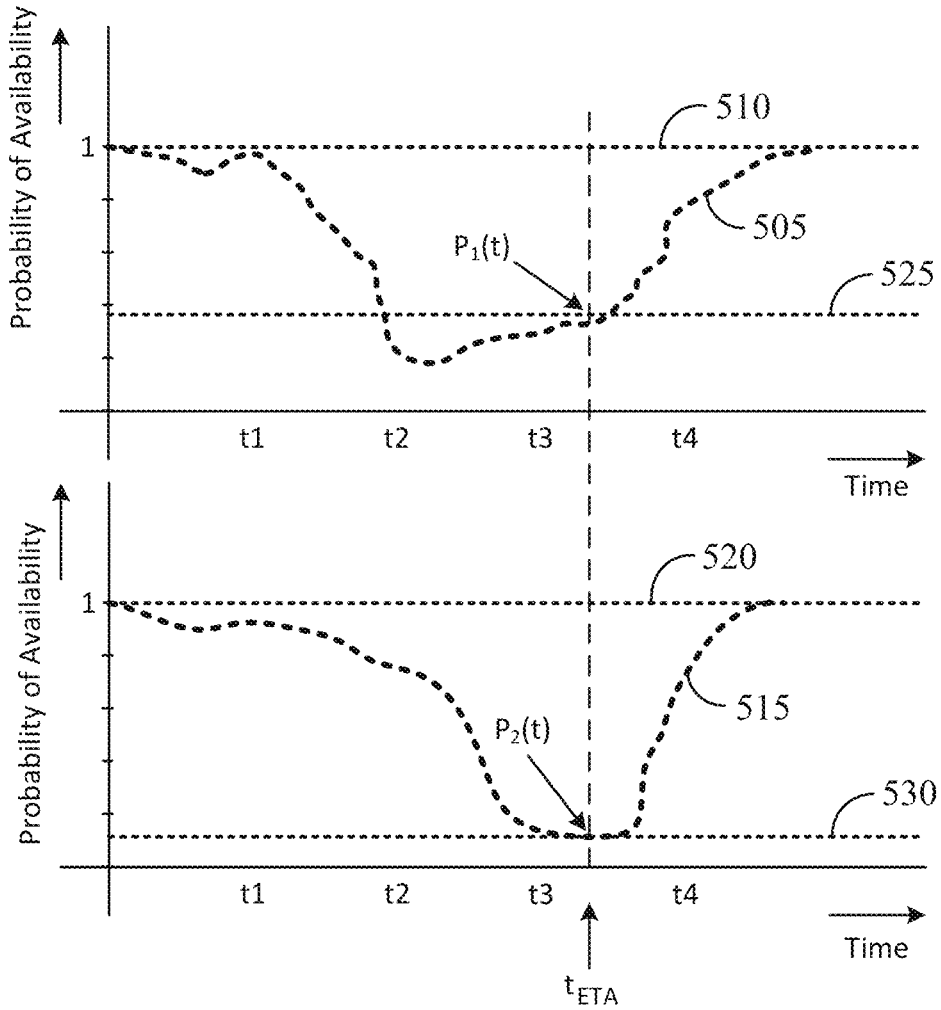
FIG. 5 shows two probability charts that may be used by a parking spot locator computer to determine an availability of at least one parking spot among the two parking spots in accordance with the disclosure.

FIG. 5 shows two probability charts that may be used by a parking spot locator computer to determine an availability of at least one parking spot among the two parking spots in accordance with the disclosure. In another example implementation, more than two probability charts ("n">2) may be used by a parking spot locator computer to determine an availability of at least one parking spot among the "n" parking spots in accordance with the disclosure.

The envelope 505 corresponds to a probability of availability of a first parking spot over a period of time (a day, for example). A level 510 corresponds to a 100% probability that the first parking spot is available. The probability of availability of the first parking spot $P_1(t)$ at an expected time of arrival ($t_{ETA}$) of the vehicle 105 at the first parking spot is indicated by the dashed line 525. In this example, there is a 38% probability that the first parking spot is available at the expected time of arrival ($t_{ETA}$) of the vehicle 105 at the first parking spot.

The envelope 515 corresponds to a probability of availability of a second parking spot over the same period of time (a day, for example). A level 520 corresponds to a 100% probability that the second parking spot $P_2(t)$ is available. The availability of the second parking spot at the expected time of arrival ($t_{ETA}$) of the vehicle 105 at the second parking spot is indicated by the dashed line 530. In this example, there is a 12% probability that the second parking spot is available at the expected time of arrival ($t_{ETA}$) of the vehicle 105 at the second parking spot.

Based on use of the probability of availability chart shown in FIG. 5, the probability $A_{12}(t)$ of at least one of the first parking spot or the second parking spot being available at any given instant in time can be expressed by the following equation:

$$A_{12}(t)=P_1(t)+P_2(t)-(P_1(t)*P_2(t))$$

The description provided above with reference to one or two parking spots, is equally applicable to "n" number of parking spots ($n\geq 1$) in a cluster of parking spots. Thus, for example, the probability ($A_{123}(t)$) of at least one of three parking spots being available at any given instant in time can be expressed by the following equation:

$$A_{123}(t)=P_1(t)+P_2(t)+P_3(t))-(P_1(t)*P_2(t))-(P_2(t)*P_3(t))-(P_1(t)*P_3(t))-(P_1(t)*P_2(t)*P_3(t))$$

Figure 6:
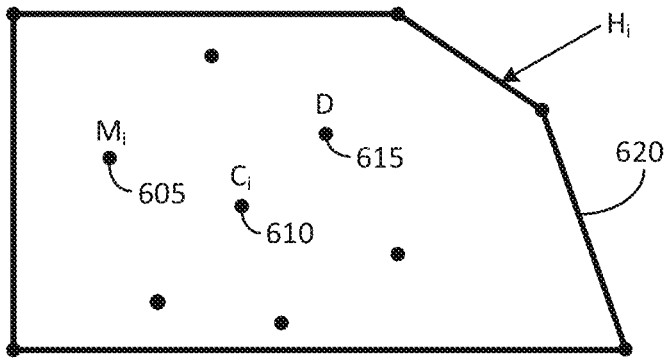
FIG. 6 shows an example convex hull that may be used to identify an available parking spot for a vehicle in accordance with an embodiment of the disclosure.

FIG. 6 shows an example convex hull 620 that may be used by the parking spot locator computer 107 to determine an availability of a parking spot in accordance with the disclosure. Details about generation of the convex hull 620 are provided below (flowchart 700 in FIG. 7). The spot 605 represents a parking meter at a parking spot, the spot 615 represents a destination for the vehicle 105, and the spot 610 represents a centroid of the convex hull 620.

Figure 7:
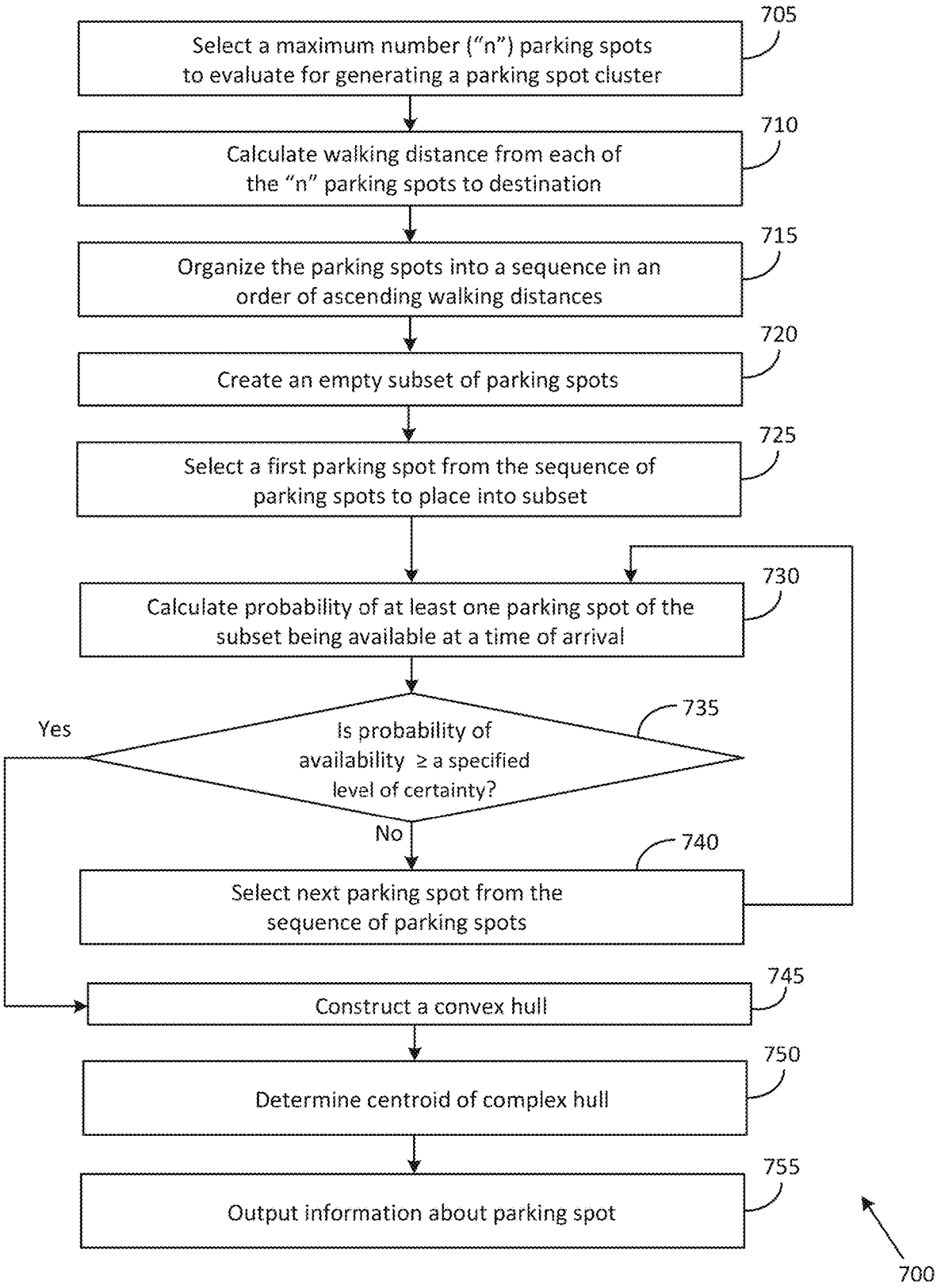
FIG. 7 shows a flowchart of an example method to identify a vacant parking spot in accordance with an embodiment of the disclosure.

FIG. 7 shows a flowchart 700 of an example method that the parking spot locator computer 107 can use to identify a vacant parking spot in accordance with an embodiment of the disclosure. The flowchart 700 illustrates a sequence of operations that can be implemented in hardware, software, or a combination thereof. In the context of software, the operations represent computer-executable instructions stored on one or more non-transitory computer-readable media such as a memory 820 (described below), that, when executed by one or more processors such as the processor 815 (described below), perform the recited operations. Generally, computer-executable instructions include routines, programs, objects, components, data structures, and the like that perform particular functions or implement particular abstract data types. The order in which the operations are described is not intended to be construed as a limitation, and any number of the described operations may be carried out in a different order, omitted, combined in any order, and/or carried out in parallel. Some or all of the operations described in the flowchart 700 may be carried out by the parking spot locator computer 107 independently or in cooperation with the server computer 120. The description below may make reference to certain components and objects shown in FIGS. 1-6, but it should be understood that this is done primarily for purposes of explaining certain aspects of the disclosure and that the description is equally applicable to many other embodiments.

At block 705, the parking spot locator computer 107 may select a maximum number ("n") parking spots to evaluate for determining a cluster of parking spots located in a vicinity of a destination for the vehicle 105. The value "n" may be based on various factors. In one example embodiment, the value "n" is autonomously selected by the parking spot locator computer 107 based on factors such as, for example, a geographical search area, the number of parking spots located in a geographical search area, parking spot data such as probability of availability/occupancy of parking spots, a level of certainty of finding a vacant parking spot, a time of day, a preferable maximum walking distance for the driver 112 of the vehicle 105, and/or a density of parking spots located within the specified maximum walking distance.

In another example embodiment, the value "n" may be based on input provided by an individual such as, for example, the driver 112 of the vehicle 105. The input can include, for example, the same factors as autonomously selected by the parking spot locator computer 107 or can include additional and/or different factors.

In an example implementation, the parking spot locator computer 107 may select the value "n" based on a certainty score that can be defined as $Q(x_d,y_d,t)$ where $(x_d,y_d)$ are the location coordinates of the destination and "t" is the estimated time of arrival of the vehicle 105 at the destination. The certainty score indicates a specified level of statistical certainty that at least one parking spot will be vacant and available at the expected time of arrival of the vehicle at the cluster of parking spots. Generally, the higher the certainty score, the larger the "n".

In one case, the certainty score may be selected by the parking spot locator computer 107 without input provided by the individual. In another case, the certainty score may be provided to the parking spot locator computer 107 by the individual, in the form of a preference, for example. The individual, who may be the driver 112 of the vehicle 105, may provide a desired level of certainty based on his/her knowledge of the destination and the vicinity of the destination (downtown area, business district, residential area, etc.), for example. The individual may also provide additional information in some cases, such as, for example, a maximum walking distance from parking spot to a destination.

At block 710, the parking spot locator computer 107 may identify a distance between each of the "n" parking spots and the destination for the vehicle 105. In one case, the distance can correspond to a walking distance from a parking spot to the destination. The distance can be calculated based on the driver 112 walking along streets and sidewalks, rather than a geographical distance (as the crow flies.)

At block 715, the parking spot locator computer 107 may reorganize all the parking spots into a sequence in the order of ascending walking distances associated with the parking spots selected in block 705.

At block 720, a subset is created to hold all the parking spots to be considered for the parking spot cluster. Initially the subset is empty as no parking spot has been selected to include in the cluster.

At block 725, the first parking spot in the parking spot sequence is put into the subset.

At block 730, the probability of at least one parking spot in the subset is available "G" is calculated. The probability "G" may be expressed as follows:

$$G_j=\sum_{i=1}^{j}p_i-\sum_{i=2}^{j}\sum_{k=1}^{\binom{j}{i}}\prod_{h=1}^{i}p_{t(h)}$$

where $p_i$ is the probability of any parking spot "i" in the subset of parking spots that is free at the time of arrival of the vehicle 105 and $$\sum_{k=1}^{\binom{j}{i}} \prod_{h=1}^{i} p_{t(h)}$$

is the summation of probability that, for any combination of "i" parking spot from the set of "j" parking spot, all of the "i" parking spots are free at the time of arrival of the vehicle 105 at the cluster of parking spots.

At block 735 a determination is made whether the probability of at least one parking spot in the subset being available is greater than a specified certainty level. In one example implementation, the specified certainty level can be specified by an individual such as, for example, the driver 112 of the vehicle 105.

If the probability of at least one parking spot being available is greater than or equal to the specified certainty level, the process proceeds to block 745.

If the probability of at least one parking spot being available is less than the specified certainty level, at block 740, select the next parking spot from the sequence, calculate the probability of at least one parking spot being available and proceed to block 730.

The process repeats itself until the probability of at least one parking spot in the subset being available is greater than or equal to the specified level of certainty.

Next, at block 745, a convex hull can be constructed based on the locations of all the parking spots in the subset.

Finally, at block 750, the centroid "C" of the convex hull may also be determined.

In an example implementation, the parking spot locator computer 107 may instruct the driver 112 of the vehicle 105 to drive the centroid of the convex hull and may provide an instruction update of parking spot availability once the vehicle 105 reaches the perimeter of the convex hull. The centroid of the convex hull may also be used by the parking spot locator computer 107 to provide distance information to the driver 112, such as, for example, a walking distance from the centroid of the convex hull to the destination.

At block 755, information is provided by the parking spot locator computer 107 to an individual such as the driver 112 of the vehicle 105. The information can include, for example, walking distances from one or more parking spots, walking distance from the centroid of the convex hull, and/or certainty of availability information about one of more parking spots.

Figure 8:
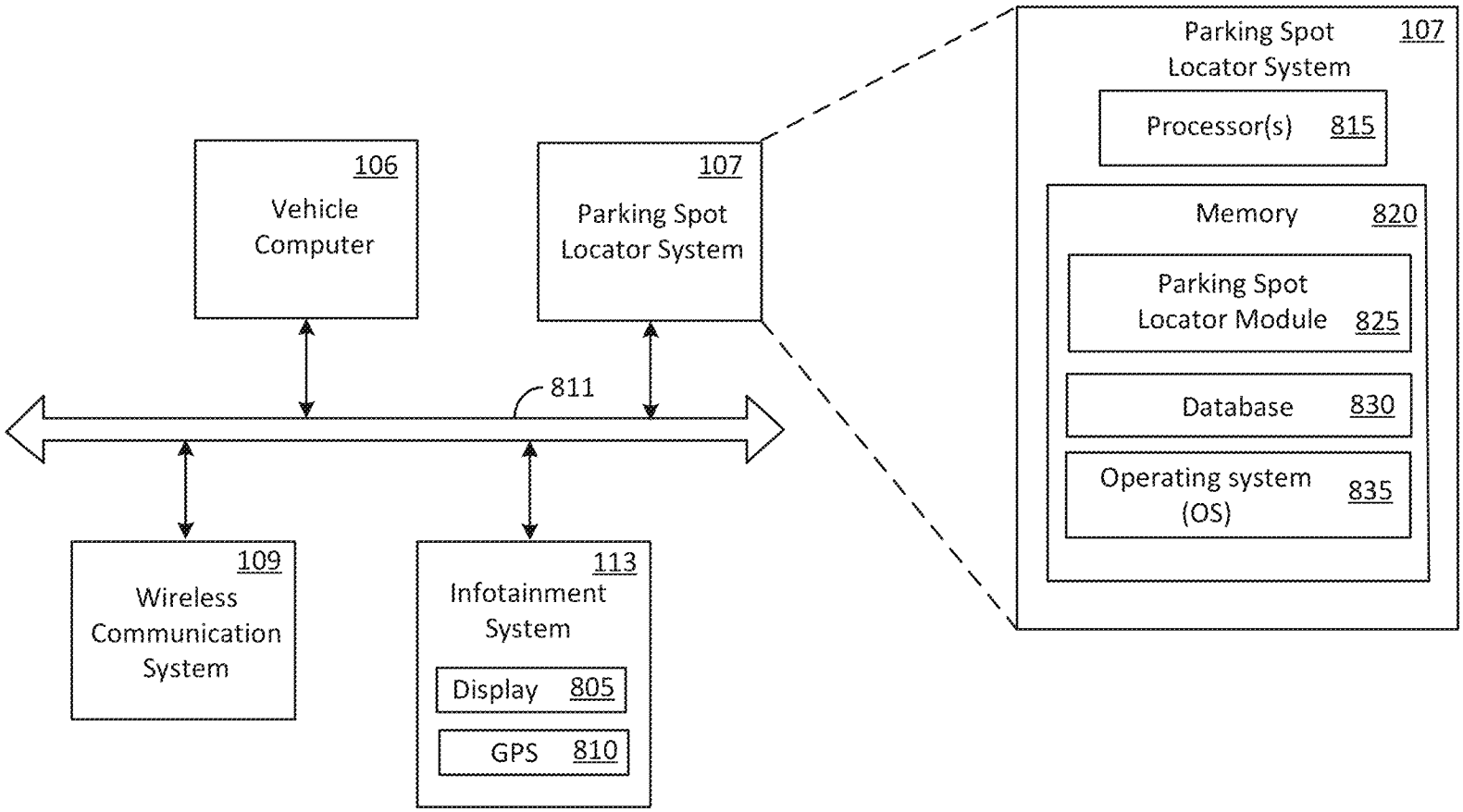
FIG. 8 shows some example components that may be included in a vehicle configured to automatically locate a vacant parking spot in accordance with an embodiment of the disclosure.

FIG. 8 shows some example components that may be included in the vehicle 105 in accordance with an embodiment of the disclosure. The example components can include the vehicle computer 106, the parking spot locator computer 107, the wireless communication system 109, and the infotainment system 113, which are communicatively coupled to each other via a bus 811.

The bus 811 can be implemented using one or more of various wired and/or wireless technologies. For example, the bus 811 can be a vehicle bus that uses a controller area network (CAN) bus protocol, a Media Oriented Systems Transport (MOST) bus protocol, and/or a CAN flexible data (CAN-FD) bus protocol. Some or all portions of the bus 811 may also be implemented using wireless technologies such as Bluetooth®, ZigBee®, or near-field-communications (NFC), cellular, Wi-Fi, Wi-Fi direct, machine-to-machine communication, and/or man-to-machine communication to accommodate communications between the parking spot locator computer 107 and various devices, such as, for example, the personal communication device 111.

The wireless communication system 109 may include elements such as, for example, wireless transmitters and receivers that enable communications between the parking spot locator computer 107 and the computer 126 in the records agency 125 and/or the server computer 120.

The infotainment system 113 can be an integrated unit that includes various components such as a radio, streaming audio solutions, and USB access ports for digital audio devices, with elements such as a navigation system that provides navigation instructions to the driver 112 of the vehicle 105. In an example implementation, the infotainment system 113 includes a display 805 and a GPS unit 810. The display 805 may include a graphical user interface (GUI) for use by the driver 112 and/or by an occupant of the vehicle 105, to make a request to the parking spot locator computer 107 for locating a vacant parking spot. The GUI may be omitted in implementations where the vehicle 105 is an autonomous vehicle.

The display 805 may also be employed by the parking spot locator computer 107 to display various types of alerts and messages associated with locating a vacant parking spot. The parking spot locator computer 107, may, for example, display on the display 805, a directive to the driver 112 to drive to a specific parking spot within a cluster of parking spots located near a travel destination for the vehicle 105.

The parking spot locator computer 107 may be provided in the form of a computer that includes a processor 815 and a memory 820. The memory 820, which is one example of a non-transitory computer-readable medium, may be used to store an operating system (OS) 835 and various code modules such as, for example, a parking spot locator module 825. The code modules are provided in the form of computer-executable instructions that can be executed by the processor 815 for performing various operations in accordance with the disclosure. More particularly, the parking spot locator module 825 may be executed by the processor 815 for performing various operations in accordance with the disclosure.

The database 830 may be used to store various types of information such as for example, destination addresses, parking spot availability in different areas, and parking fees.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, one skilled in the art will recognize such feature, structure, or characteristic in connection with other embodiments whether or not explicitly described.

Implementations of the systems, apparatuses, devices, and methods disclosed herein may comprise or utilize one or more devices that include hardware, such as, for example, one or more processors and system memory, as discussed herein. An implementation of the devices, systems, and methods disclosed herein may communicate over a computer network. A "network" is defined as one or more data links that enable the transport of electronic data between computer systems and/or modules and/or other electronic devices. When information is transferred or provided over a network or another communications connection (either hardwired, wireless, or any combination of hardwired or wireless) to a computer, the computer properly views the connection as a transmission medium. Transmission media can include a network and/or data links, which can be used to carry desired program code means in the form of computer-executable instructions or data structures and which can be accessed by a general purpose or special purpose computer. Combinations of the above should also be included within the scope of non-transitory computer-readable media.

Computer-executable instructions comprise, for example, instructions and data which, when executed at a processor, such as the processor 815, cause the processor to perform a certain function or group of functions. The computer-executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

A memory device such as the memory 820, can include any one memory element or a combination of volatile memory elements (e.g., random access memory (RAM, such as DRAM, SRAM, SDRAM, etc.)) and non-volatile memory elements (e.g., ROM, hard drive, tape, CDROM, etc.). Moreover, the memory device may incorporate electronic, electromagnetic, optical, and/or other types of storage media. In the context of this document, a "non-transitory computer-readable medium" can be, for example but not limited to, an electronic, electromagnetic, optical, electromagnetic, infrared, or semiconductor system, apparatus, or device. More specific examples (a non-exhaustive list) of the computer-readable medium would include the following: a portable computer diskette (electromagnetic), a random-access memory (RAM) (electronic), a read-only memory (ROM) (electronic), an erasable programmable read-only memory (EPROM, EEPROM, or Flash memory) (electronic), and a portable compact disc read-only memory (CD ROM) (optical). Note that the computer-readable medium could even be paper or another suitable medium upon which the program is printed, since the program can be electronically captured, for instance, via optical seaming of the paper or other medium, then compiled, interpreted or otherwise processed in a suitable manner if necessary, and then stored in a computer memory.

Those skilled in the art will appreciate that the present disclosure may be practiced in network computing environments with many types of computer system configurations, including in-dash vehicle computers, personal computers, desktop computers, laptop computers, message processors, handheld devices, multi-processor systems, microprocessor-based or programmable consumer electronics, network PCs, minicomputers, mainframe computers, mobile telephones, PDAs, tablets, pagers, routers, switches, various storage devices, and the like. The disclosure may also be practiced in distributed system environments where local and remote computer systems, which are linked (either by hardwired data links, wireless data links, or by any combination of hardwired and wireless data links) through a network, both perform tasks. In a distributed system environment, program modules may be located in both the local and remote memory storage devices.

Further, where appropriate, the functions described herein can be performed in one or more of hardware, software, firmware, digital components, or analog components. For example, one or more application specific integrated circuits (ASICs) can be programmed to carry out one or more of the systems and procedures described herein. Certain terms are used throughout the description, and claims refer to particular system components. As one skilled in the art will appreciate, components may be referred to by different names. This document does not intend to distinguish between components that differ in name, but not in function.

At least some embodiments of the present disclosure have been directed to computer program products comprising such logic (e.g., in the form of software) stored on any computer-usable medium. Such software, when executed in one or more data processing devices, causes a device to operate as described herein.

While various embodiments of the present disclosure have been described above, it should be understood that they have been presented by way of example only, and not limitation. It will be apparent to persons skilled in the relevant art that various changes in form and detail can be made therein without departing from the spirit and scope of the present disclosure. Thus, the breadth and scope of the present disclosure should not be limited by any of the above-described example embodiments but should be defined only in accordance with the following claims and their equivalents. The foregoing description has been presented for the purposes of illustration and description. It is not intended to be exhaustive or to limit the present disclosure to the precise form disclosed. Many modifications and variations are possible in light of the above teaching. Further, it should be noted that any or all of the aforementioned alternate implementations may be used in any combination desired to form additional hybrid implementations of the present disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather the specific features and acts are disclosed as illustrative forms of implementing the embodiments. Conditional language, such as, among others, "can" "could," "might," or "may," unless specifically stated otherwise, or otherwise understood within the context as used, is generally intended to convey that certain embodiments, could include, while other embodiments may not include, certain features, elements, and/or steps. Thus, such conditional language is not generally intended to imply that features, elements, and/or steps are in any way required for one or more embodiments.

That which is claimed is:

1. A method comprising:

receiving, by a processor, a request to provide parking spot availability information in a vicinity of a destination for a vehicle;

identifying, by the processor, a cluster of parking spots based on determining a statistical probability that at least one parking spot in the cluster of parking spots is available at an expected time of arrival of the vehicle at the cluster of parking spots; and providing, by the processor, a first routing instruction directing the vehicle to travel to the cluster of parking spots, wherein identifying the cluster of parking spots comprises:

determining, by the processor, a total number of parking spots for evaluation to identify the cluster of parking spots;

reorganizing, by the processor, the total number of parking spots into a sequence of parking spots, arranged in an order of ascending walking distances from the destination;

generating, by the processor, a subset of parking spots based on evaluating each parking spot in the sequence of parking spots until a probability of at least one parking spot being available in the subset of parking spots is at equal to or greater than a specified level of statistical certainty;

constructing, by the processor, a convex hull based on the subset of parking spots, the convex hull defining a perimeter of the cluster of parking spots; and calculating a centroid of the convex hull.

2. The method of claim 1, wherein determining the statistical probability that the at least one parking spot in the cluster of parking spots is available at the expected time of arrival of the vehicle at the cluster of parking spots is based on a statistical analysis of an occupancy history of each parking spot in the cluster of parking spots.

3. The method of claim 1, wherein the first routing instruction directs the vehicle to travel to the centroid of the convex hull.

4. The method of claim 3, wherein the vehicle is operated by a driver, and wherein the method further comprises:

providing, by the processor, to the driver, a probability of availability information of a first parking spot in the cluster of parking spots at the expected time of arrival of the vehicle at the perimeter of the cluster of parking spots.

5. The method of claim 3, wherein the vehicle is operated by a driver, and wherein the method further comprises:

providing, by the processor, to the driver, a walking distance information from the centroid of the convex hull to the destination.

6. The method of claim 4, further comprising:

providing, by the processor, a set of walking instructions to the driver of the vehicle to walk from the centroid of the convex hull to the destination.

7. A method comprising:

receiving, by a processor, a request to provide parking spot availability information in a vicinity of a destination for a vehicle;

determining, by the processor, a total number of parking spots for evaluation to identify a cluster of parking spots;

evaluating, by the processor, each parking spot in the total number of parking spots to determine an availability of each parking spot at an expected time of arrival of the vehicle at the cluster of parking spots;

selecting, by the processor, based on the evaluating, a subset of parking spots among the total number of parking spots;

constructing, by the processor, a convex hull based on the subset of parking spots, the convex hull defining a perimeter of the cluster of parking spots; and providing, by the processor, a first routing instruction directing the vehicle to travel to a centroid of the convex hull.

8. The method of claim 7, wherein determining the availability of each parking spot is subject to a level of certainty specified in the request.

9. The method of claim 7, wherein the vehicle is operated by a driver, and wherein the method further comprises:

providing, by the processor, to the driver of the vehicle, a probability of availability information of a first parking spot in the cluster of parking spots at the expected time of arrival of the vehicle at the perimeter of the cluster of parking spots.

10. The method of claim 9, further comprising:

providing, by the processor, a second routing instruction directing the vehicle to travel from the perimeter of the cluster of parking spots to the first parking spot subject to availability of the first parking spot at the expected time of arrival of the vehicle at the perimeter of the cluster of parking spots.

11. The method of claim 9, further comprising:

determining, by the processor, an availability of the first parking spot at a time of arrival of the vehicle at the perimeter of the cluster of parking spots; and providing, by the processor, a second routing instruction directing the vehicle to travel from the perimeter of the cluster of parking spots to the first parking spot when the first parking spot is available at the time of arrival of the vehicle at the perimeter of the cluster of parking spots.

12. The method of claim 11, further comprising:

providing, by the processor, a third routing instruction directing the vehicle to travel from the perimeter of the cluster of parking spots to a second parking spot when the first parking spot is unavailable at the time of arrival of the vehicle at the perimeter of the cluster of parking spots.

13. The method of claim 7, wherein determining the availability of each parking spot at the expected time of arrival of the vehicle at the cluster of parking spots is based on a statistical analysis of an occupancy history of each parking spot in the cluster of parking spots.

14. A device comprising:

a computer that includes:

a memory containing computer-executable instructions; and a processor configured to access the memory and execute the computer-executable instructions to perform operations comprising:

receiving a request to provide parking spot availability information in a vicinity of a destination for travel by a vehicle;

determining a total number of parking spots for evaluation to identify a cluster of parking spots;

evaluating each parking spot in the total number of parking spots to determine an availability of each parking spot at an expected time of arrival of the vehicle at the cluster of parking spots;

selecting based on the evaluating, a subset of parking spots among the total number of parking spots;

constructing a convex hull based on the subset of parking spots, the convex hull defining a perimeter of the cluster of parking spots; and providing a first routing instruction directing the vehicle to travel to a centroid of the convex hull.

15. The device of claim 14, wherein the computer is one of located in the vehicle or in a personal communication device, and wherein the computer further includes an input/output interface configured to accept input information comprising a specified level of certainty, and wherein the processor determines the availability of each parking spot based on the specified level of certainty.

16. The device of claim 15, wherein the vehicle is a delivery vehicle, and wherein the input information includes a specified maximum walking distance that is defined on the basis of an expected walking distance to be traversed by a driver of the delivery vehicle when carrying a package for delivery at the destination and/or on the basis of a weight, a size, and/or a shape of the package.

17. The device of claim 16, wherein the specified level of certainty is defined on the basis of a density of parking spots located within the specified maximum walking distance.

18. The device of claim 15, wherein the vehicle is an autonomous vehicle and the computer is located in the autonomous vehicle.

19. The device of claim 18, wherein the vehicle is an autonomous delivery vehicle and wherein the input information includes a specified maximum walking distance that is defined on the basis of an expected walking distance to be traversed by a customer from the destination to the autonomous delivery vehicle.

* * * * *